US006010346A

United States Patent [19]

Wang

[11] Patent Number: 6,010,346

[45] Date of Patent: Jan. 4, 2000

[54] LIGHT BULB SOCKET WITH WATER DRAINING STRUCTURE

[76] Inventor: Jessica Wang, 4F-3, No. 77, Sec. 2, TUN HWA South Rd., Taipei, Taiwan

[21] Appl. No.: 08/975,949

[22] Filed: Nov. 21, 1997

[51] Int. Cl.[7] ..... H01R 4/64

[52] U.S. Cl. ..... 439/206; 439/340

[58] Field of Search ..... 439/206, 419, 439/602, 340, 414

[56] References Cited

U.S. PATENT DOCUMENTS 5,848,909 12/1998 Tsai ..... 439/206

*Primary Examiner*—Neil Abrams
*Assistant Examiner*—Eugene G. Byrd
*Attorney, Agent, or Firm*—Dougherty & Troxell

[57] ABSTRACT

A bulb socket with water draining structure is disclosed, including a water drainage hole formed on a side wall of the socket to allow water entering the socket to be expelled therethrough. The bulb socket also includes shielding members which shield the central contact and side contact of the bulb socket which are to be contacted by the tip contact and the ring contact of a bulb when the bulb is inserted into the socket and protect the central contact and the side contact from being contacted by the water entering the bulb socket in order to avoid short-circuiting. Also, a ventilation channel extends along the side wall of the socket to an open top end of the socket so as to facilitate to balance the pressure inside the socket which helps draining water through the drainage hole.

4 Claims, 3 Drawing Sheets

LIGHT BULB SOCKET WITH WATER DRAINING STRUCTURE

FIELD OF THE INVENTION

The present invention relates generally to a light bulb socket and in particular to a light bulb socket having water draining structure for expelling water accumulated therein so as to avoid potential short-circuiting.

BACKGROUND OF THE INVENTION

Decorative light strings have been widely used both indoors and outdoors. The light strings comprise electrical wires on which a plurality of bulb sockets or bulb stands are arranged. Each of the bulb sockets is capable of receiving and holding a standard light bulb thereon.

When used outdoors, the light strings are subject to bad weather conditions, such as raining or snowing, which causes water accumulation inside the sockets and thus may result in short-circuiting. An example of the conventional light bulb socket is shown in FIG. 1 of the attached drawings, which is designated generally at 2, comprising a container-like body 20 inside which a central contact and a side contact (both not shown) are provided to establish electrical connection with the tip contact and ring contact of a bulb 1 that is mounted in the socket body 20.

Two electric wires 3 extend through the socket body 20 via side openings 21 on the socket body 20 to electrically connect to the central and side contacts of the socket 2. When the bulb 1 is mounted into the socket 2, the tip contact and ring contact of the bulb 1 are engaged by the central contact and side contact of the socket 2 that are in electrical connection with the wires 3, electricity is supplied from the wires 3 to the bulb 1 via the contacts so as to light the bulb 1.

The conventional bulb socket 20 comprises an open end to receive the bulb 1 therein so that when the bulb socket 20 is used outdoors, water may be deposited therein due to for example rain, which as discussed above may cause short-circuiting.

Thus, it is desired to improve the conventional bulb socket to avoid the accumulation of water inside the socket and thus substantially reduce and even eliminate the potential short-circuiting.

SUMMARY OF THE INVENTION

Therefore, an object of the present invention is to provide an improvement of a bulb socket structure to incorporate therein water draining means so as to expel the water accumulated therein in order to reduce the likelihood of short-circuiting.

Another object of the present invention is to provide an electrically safer bulb socket structure inside which contact shields are provided to shield the central and side contacts of the socket from contact with water deposited into and accumulated inside the socket so as to reduce the likelihood of short-circuiting.

A further object of the present invention is to provide a ventilation channel which balances the pressure between the inside of the socket and the atmosphere so as to facilitate the drainage of the water accumulated inside the socket.

BRIEF DESCRIPTION OF THE DRAWINGS

The present invention will be better understood from the following description of preferred embodiments thereof, with reference to the attached drawings, wherein.

DETAILED DESCRIPTION OF THE PREFERRED EMBODIMENTS

Figure 2:
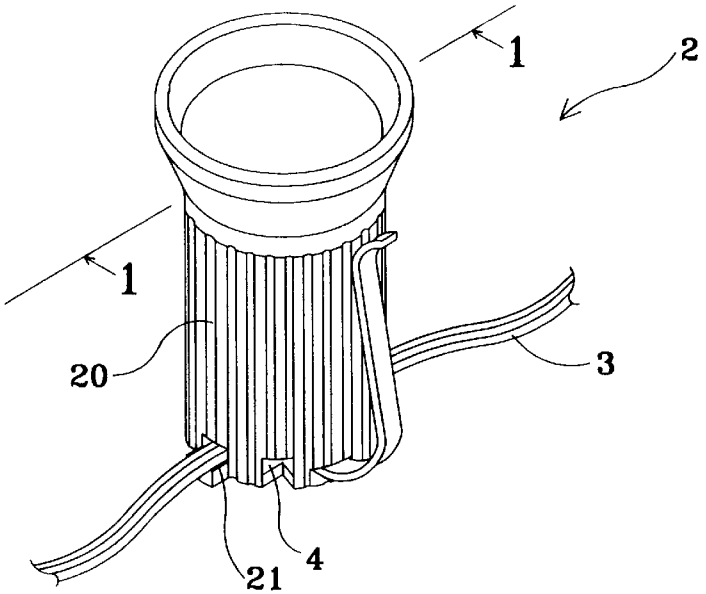
FIG. 2 is a perspective view showing a bulb socket constructed in accordance with a first embodiment of the present invention.
Figure 1:
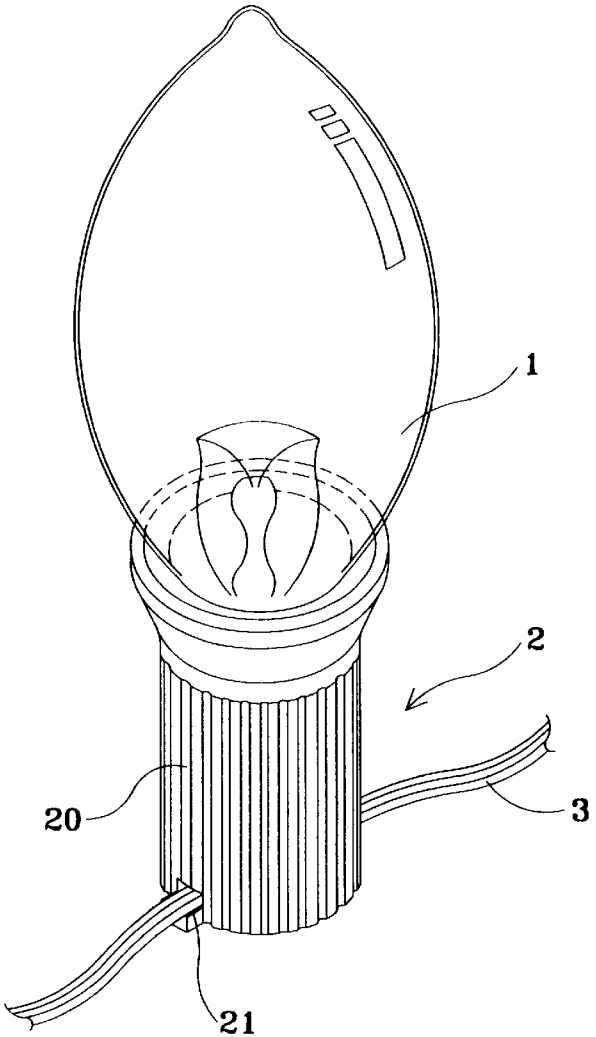
Fig. 1 (PRIOR ART)
FIG. 1 is a perspective view showing a prior art bulb socket with a bulb mounted therein.
Figure 3:
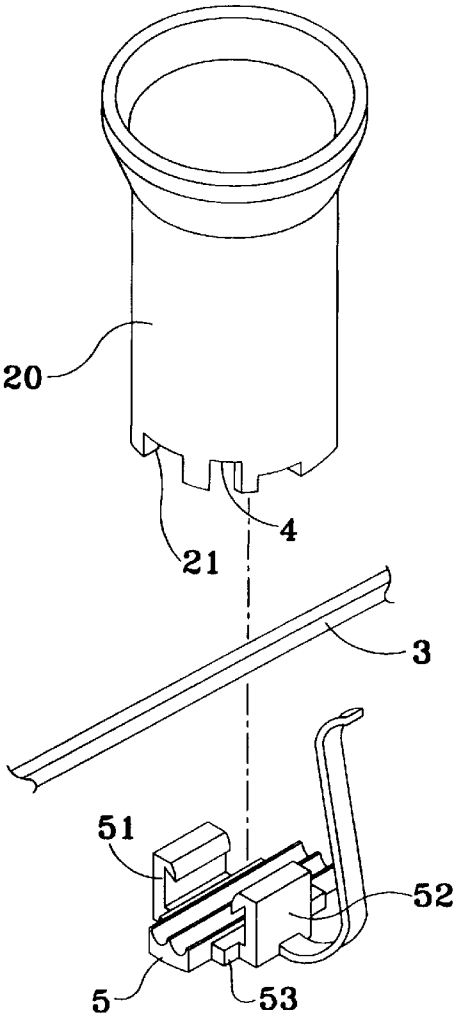
FIG. 3 is an exploded perspective view of the first embodiment bulb socket of the present invention.

With reference to the drawings and in particular to FIGS. 2 and 3, wherein a bulb socket constructed in accordance with a first embodiment of the present invention is shown, the bulb socket of the present invention which is also designated at 2 in the drawings comprises a container-like socket body 20 comprising a side wall having an inside surface defining an interior space with an open top end to receive and hold therein a bulb (not shown in FIGS. 2–6) and a bottom cover 5 which is attached to a bottom end of the socket body 20.

Figure 4:
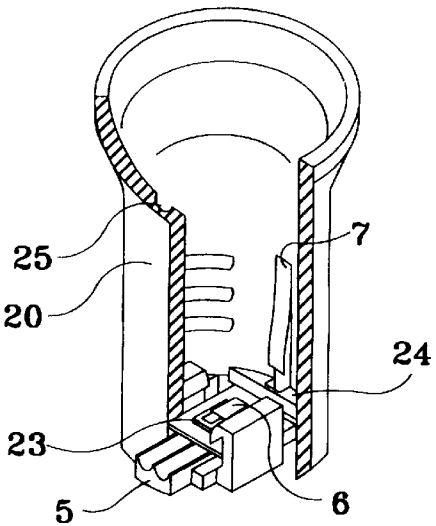
FIG. 4 is a side elevational view of the first embodiment bulb socket which is partially broken away to show the inside structure thereof.
Figure 5:
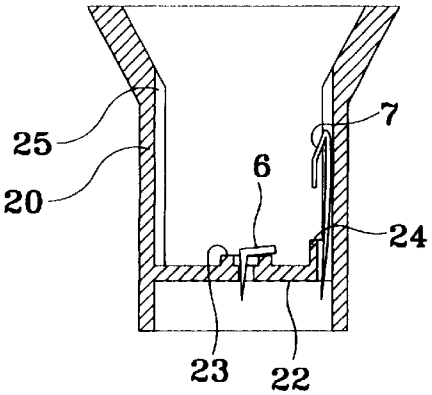
FIG. 5 is a cross-sectional view of the bulb socket taken along line 1—1 of FIG. 2.

Further referring to FIGS. 4 and 5, the socket body 20 comprises a transverse support plate 22 fixed therein to define two opposite passages with the inside surface of the socket body 20. The bottom cover 5 comprises two opposite, resilient paws 51 and 52 engageable with the support plate 22 by extending through the passages defined by the support plate 22 and the socket body 20 so as to attach the bottom cover 5 to the socket body 20. Wires 3 are arranged between the bottom cover 5 and the socket body 20 to extend through the socket body 22 and out thereof via openings 21 (only one being shown) formed on the socket body 22 so as to supply power to the bulb mounted in the socket 2.

In accordance with the present invention, a drainage hole or opening 4 is formed on the socket body 20 which in the embodiment illustrated is located on the bottom edge of the socket body 20 and in the proximity of the paw 52 of the bottom cover 5, namely in the lowermost position of the socket body 20 so that water entering the socket body 20 may be easily drained through the hole 4.

Figure 6:
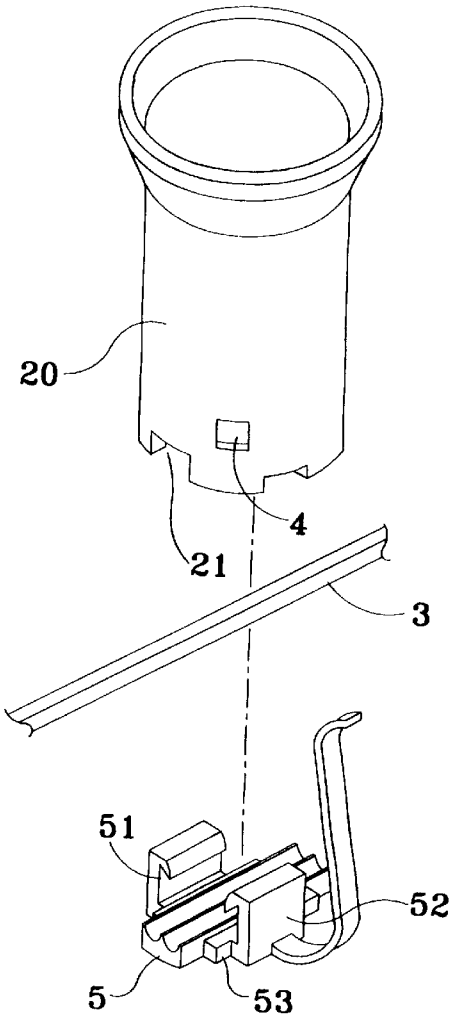
FIG. 6 is an exploded perspective view showing a bulb socket in accordance with a second embodiment of the present invention.

It is quite apparent that the drainage hole 4 may be located at any other suitable position on the side wall of the socket body 20 provided that it is low enough to effectively drain water inside the socket body 20. FIG. 6 shows a bulb socket in accordance with a second embodiment of the present invention wherein the drainage hole 4 is formed on the side wall of the socket body 20, rather than on the bottom edge thereof.

FIG. 4 shows a side elevational view, partially broken, of the socket 2 of the present invention and FIG. 5 is a cross-sectional view of the socket 2. Inside the socket 2, a central conductive contact 6 and a side conductive contact 7, both preferably made of metal, are provided. The central contact 6 is located on the support plate 22 and substantially centered in the socket body 20 to be engageable by a tip contact of the bulb and the side contact 7 is substantially fixed to and extending along the inside surface of the socket body 20 to be engageable with a ring contact of the bulb.

In accordance with the present invention, the support plate 22 comprises a raised section 23 surrounding the central contact 6 in order to shield the central contact 6 from being contacted by water entering the socket body 20 and deposited on the support plate 22. Similarly, a further raised section 24 is also provided on the support plate 22 to shield the side contact 7 for the same purpose.

Quite apparently, the water drainage hole 4 is necessarily located below the contact shields 23 and 24 in order to prevent the water from flowing over the shields 23 and 24 and contacting the central and side contacts 6 and 7.

Furthermore, in accordance with the present invention, the socket body 20 is provided with a ventilation channel 25 extending along the inside surface to the open end of the socket body 20 which facilitates balancing the pressure inside the socket body 20 when the bulb is tightly mounted therein in order to help drainage of water out of the socket body 20 via the drainage hole it.

With the present inventive arrangement discussed above, the bulb socket is capable to effectively and efficiently drain water entering therein through the drainage hole with the aid of the ventilation channel and to prevent the water from contacting the central and side contacts thereof by means of the contact shields so that an electrically safer bulb structure is provided which substantially reduces and even eliminates the likelihood of short-circuiting caused by water accumulated inside the socket.

Although the preferred embodiments have been described to illustrate the present invention, it is apparent that changes and modifications in the specifically described embodiments can be carried out without departing from the scope of the invention which is intended to be limited only by the appended claims.

I claim:

1. A bulb socket with a water draining structure, comprising:

a socket body comprising a side wall having an inside surface defining an interior space with an open first end adapted to receive therein a bulb and a second end portion with a support plate fixed inside the interior space of the socket;

a central contact supported on and extending through the support plate;

a side contact attached to the inside surface of the socket body and having a portion extending through the support plate;

a cover member attached to the second end portion of the socket body to support a pair of electrical wires extending between the second end portion of the socket body and the cover member;

a first contact shield extending from the support plate into the interior space of the socket body adjacent to the central contact, the first contact shield having a first distal edge located a first predetermined distance from the support plate;

a second contact shield extending from the support plate into the interior space of the socket body adjacent to the side contact, the second contact shield having a second distal edge located a second predetermined distance from the support plate;

a drainage hole formed in the side wall of the socket body, at least a portion of the drainage hole being located below the first and second distal edges of the first and second contact shields for drainage of water from inside the socket body.

2. The bulb socket as claimed in claim 1, wherein the socket body further comprises a ventilation channel communicating with the interior space and extending along the inside surface thereof to the open first end of the socket body.

3. The bulb socket as claimed in claim 1, wherein the drainage hole is located adjacent to the second end portion of the socket body.

4. The bulb socket as claimed in claim 3, wherein the socket body further comprises a ventilation channel communicating with the interior space and extending along the inside surface thereof to the open first end of the socket body.

* * * * *